US010525993B2

(12) United States Patent
Hou

(10) Patent No.: US 10,525,993 B2
(45) Date of Patent: Jan. 7, 2020

(54) RAILWAY TURNOUT CONTROL METHOD AND SYSTEM

(71) Applicant: COORDEM TRANSPORT TECH. CO., LTD., Shenzhen, Guangdong (CN)

(72) Inventor: Mancang Hou, Shenzhen (CN)

(73) Assignee: COORDEM TRANSPORT TECH. CO., LTD., Shenzhen (CN)

( * ) Notice: Subject to any disclaimer, the term of this patent is extended or adjusted under 35 U.S.C. 154(b) by 43 days.

(21) Appl. No.: 15/779,080

(22) PCT Filed: Nov. 25, 2015

(86) PCT No.: PCT/CN2015/095523
§ 371 (c)(1),
(2) Date: May 24, 2018

(87) PCT Pub. No.: WO2017/088121
PCT Pub. Date: Jun. 1, 2017

(65) Prior Publication Data

US 2018/0370551 A1 Dec. 27, 2018

(51) Int. Cl.
*B61L 23/30* (2006.01)
*B61B 1/00* (2006.01)

(52) U.S. Cl.
CPC ..... *B61L 23/30* (2013.01); *B61L 2201/00* (2013.01)

(58) Field of Classification Search
CPC ..... B61L 27/00; B61L 27/64; B61L 19/06; B61L 23/30; B61B 1/00; G08G 1/0967
USPC ..... 701/117
See application file for complete search history.

(56) References Cited

U.S. PATENT DOCUMENTS 6,313,546 B1 * 11/2001 Nishimura ..... H02J 7/0054 307/125
2010/0090069 A1 4/2010 Degouge et al.
2012/0323435 A1 * 12/2012 Miller ..... G01R 19/0092 701/31.4

(Continued)

FOREIGN PATENT DOCUMENTS

CN 102303629 A 1/2012
CN 103781691 A 5/2014

(Continued)

OTHER PUBLICATIONS

Extended European Search Report in European Application No. 15909033.1 dated Feb. 25, 2019, 8 pages.

(Continued)

*Primary Examiner* — Tan Q Nguyen
(74) *Attorney, Agent, or Firm* — Metis IP LLC

(57) ABSTRACT

A railway turnout control method comprises: constructing a data space corresponding to a railway turnout area (101); adding a virtual railway turnout, in the data space, to an area in which a target turnback stopping point is located (102); adding the virtual railway turnout to a railway turnout list corresponding to a route along which a train drives into the area (103); and not releasing claim of the virtual railway turnout when the train stops at the turnback stopping point (104); Also provided is a railway turnout control system. The method and system can solve problems of deadlock of a turnback area and insufficient safety protection of crossed routes.

13 Claims, 12 Drawing Sheets

(56) References Cited

U.S. PATENT DOCUMENTS

| | | | | |
|---|---|---|---|---|
| 2015/0066837 | A1* | 3/2015 | Twarog | B60L 58/12<br>706/58 |
| 2015/0191162 | A1* | 7/2015 | Dao | H04Q 9/00<br>701/22 |
| 2015/0232110 | A1 | 8/2015 | Ghaly | |

FOREIGN PATENT DOCUMENTS

| | | | |
|---|---|---|---|
| CN | 104401329 | A | 3/2015 |
| CN | 104742913 | A | 7/2015 |
| CN | 104787089 | A | 7/2015 |
| WO | 2011061131 | A1 | 5/2011 |

OTHER PUBLICATIONS

International Search Report in PCT/CN2015/095523 dated Jun. 12, 2016, 6 pages.
Written Opinion in PCT/CN2015/095523 dated Jun. 12, 2016, 6 pages.

* cited by examiner

Scene 1 (Side-in-straight-out turning back at a single crossover in a terminal station)

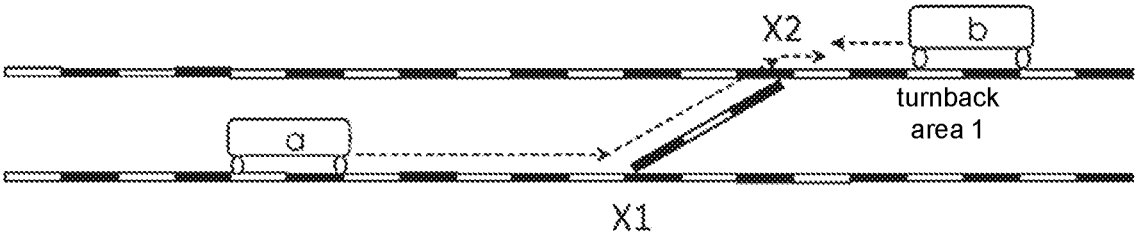

| | The list of the state(s) of the railway turnout(s) involved in the route |
|---|---|
| The route for the train *a* to drive into the "turnback area 1" | "X1 is side-passable" AND "X2 is side-passable" |
| The route for the train *b* to drive out of the "turnback area 1" | "X2 is straight-passable" |

FIG. 3a

Improved scheme for the Scene 1

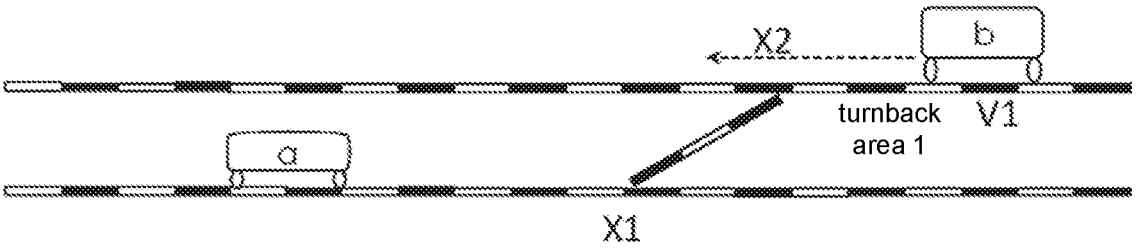

| | The list of the state(s) of the railway turnout(s) involved in the route |
|---|---|
| The route for the train *a* to drive into the "turnback area 1" | "X1 is side-passable" AND "X2 is side-passable" **AND "V1 is straight-passable"** |
| The route for the train *b* to drive out of the "turnback area 1" | "X2 is straight-passable" |

FIG. 3b

Scene 2 (Side-in-straight-out turning back at a single crossover in an intermediate station)

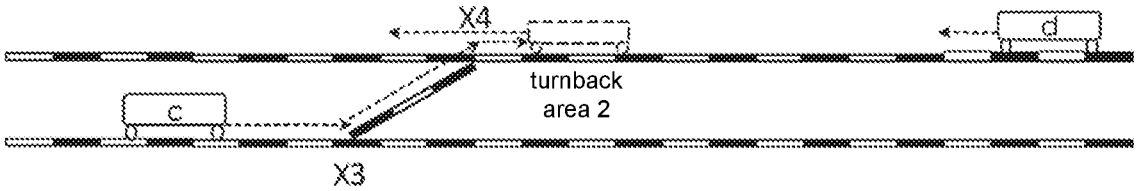

| | The list of the state(s) of the railway turnout(s) involved in the route |
|---|---|
| The route for the (short-routing) train *c* to drive into the "(short-routing) turnback area 2" | "X3 is side-passable" AND "X4 is side-passable" |
| The route for the (short-routing) train to drive out of the "(short-routing) turnback area 2" | "X4 is straight-passable" |
| The route for the (long-routing) train *d* to pass through the "(short-routing) turnback area 2" | "X4 is straight-passable" |

FIG. 4a

Improved scheme for the Scene 2

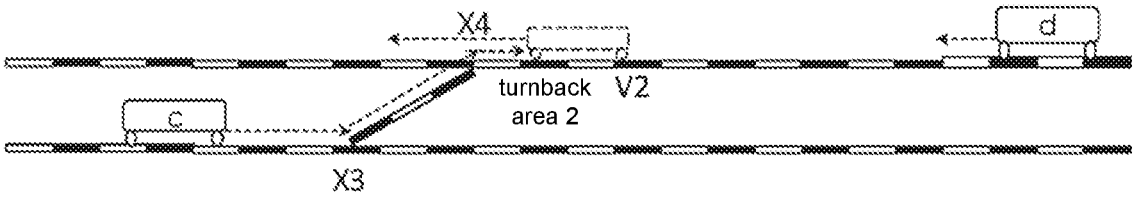

| | The list of the state(s) of the railway turnout(s) involved in the route |
|---|---|
| The route for the (short-routing) train *c* to drive into the "(short-routing) turnback area 2" | "X3 is side-passable" AND "X4 is side-passable" **AND "V2 is straight-passable"** |
| The route for the (short-routing) train to drive out of the "(short-routing) turnback area 2" | "X4 is straight-passable" |
| The route for the (long-routing) train *d* to pass through the "(short-routing) turnback area 2" | **"V2 is straight-passable" AND** "X4 is straight-passable" |

FIG. 4b

Scene 3 (Straight-in-side-out turning back at a single crossover in a terminal station)

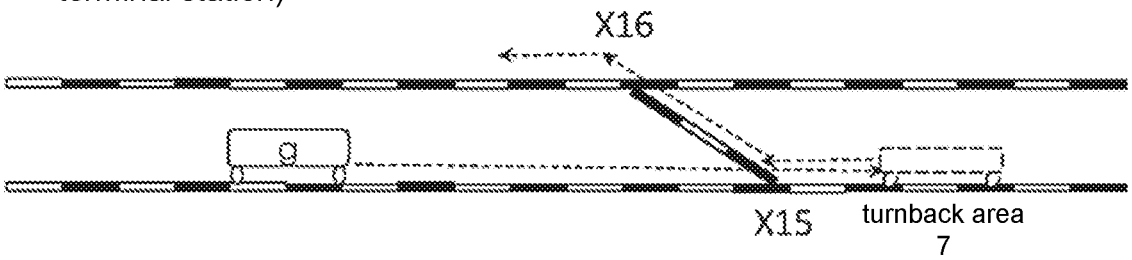

| | The list of the state(s) of the railway turnout(s) involved in the route |
|---|---|
| The route for the train *g* to drive into the "turnback area 7" | "X15 straight-passable" |
| The route for the train *g* to drive out of the "turnback area 7" | "X15 is side-passable" AND "X16 is side-passable" |

FIG. 5a

Improved scheme for the Scene 3

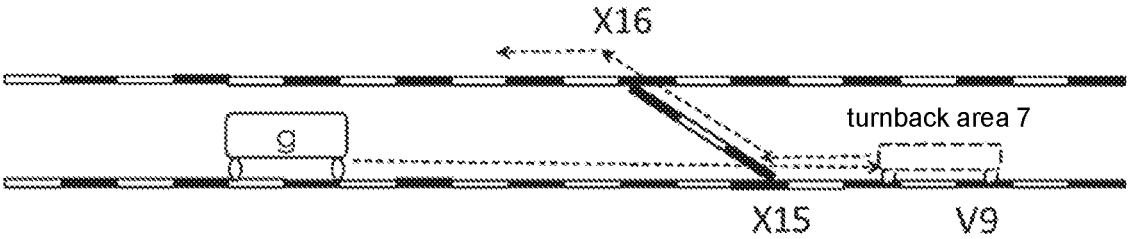

| | The list of the state(s) of the railway turnout(s) involved in the route |
|---|---|
| The route for the train *g* to drive into the "turnback area 7" | "X15 straight-passable" **AND "V9 is straight-passable"** |
| The route for the train *g* to drive out of the "turnback area 7" | "X15 is side-passable" AND "X16 is side-passable" |

FIG. 5b

Scene 4 (Straight-in-side-out turning back at a single crossover in an intermediate station)

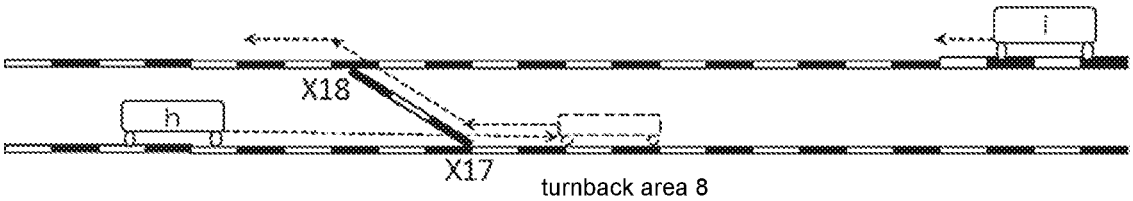

| | The list of the state(s) of the railway turnout(s) involved in the route |
|---|---|
| The route for the (short-routing) train *h* to drive into the "(short-routing) turnback area 8" | "X17 is straight-passable" |
| The route for the (short-routing) train to drive out of the "(short-routing) turnback area 8" | "X17 is side-passable" AND "X18 is side-passable" |
| The route for the (long-routing) train *i* to pass through the railway turnout X18 | "X18 is straight-passable" |

FIG. 6a

Improved scheme for the Scene 4

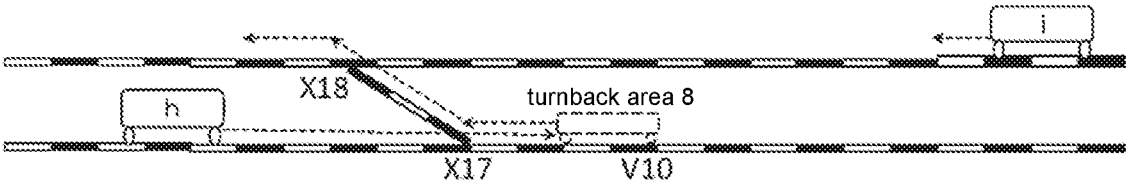

| | The list of the state(s) of the railway turnout(s) involved in the route |
|---|---|
| The route for the (short-routing) train *h* to drive into the "(short-routing) turnback area 8" | "X17 is straight-passable" **and "V10 is straight-passable"** |
| The route for the (short-routing) train to drive out of the "(short-routing) turnback area 8" | "X17 is side-passable" AND "X18 is side-passable" |
| The route for the (long-routing) train *i* to pass through the railway turnout X18 | "X18 is straight-passable" |

FIG. 6b

Scene 5 (turning back in a single turnback track parallel layout)

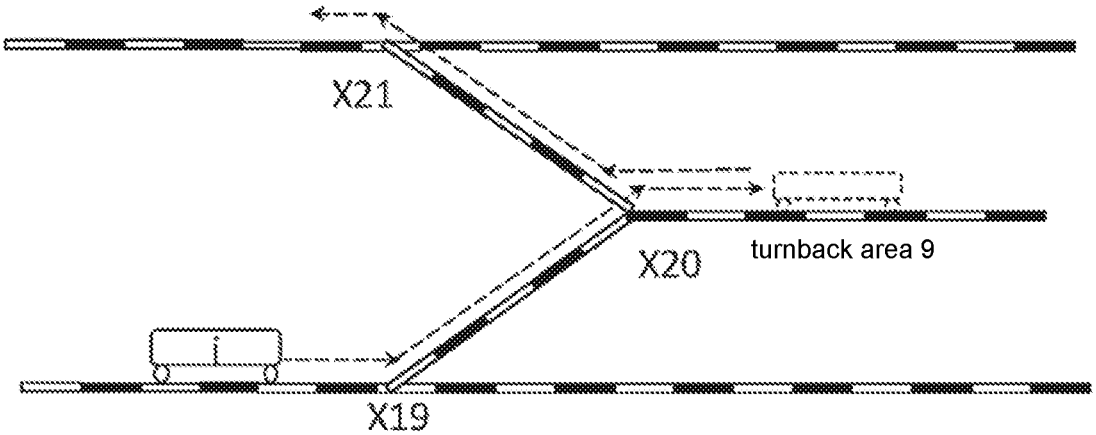

| | The list of the state(s) of the railway turnout(s) involved in the route |
|---|---|
| The route for the train *j* to drive into the "turnback area 9" | "X19 is side-passable" AND "X20 is first-direction-passable" |
| The route for the train to drive out of the "turnback area 9" | "X20 is second-direction-passable" AND "X21 is side-passable" |

FIG. 7a

Improved scheme for the Scene 5

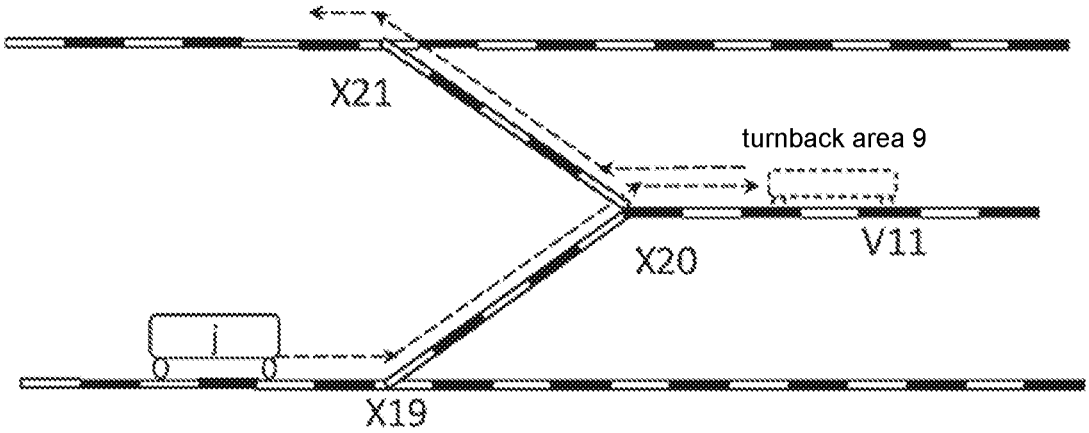

| | The list of the state(s) of the railway turnout(s) involved in the route |
|---|---|
| The route for the train *j* to drive into the "turnback area 9" | "X19 is side-passable" AND "X20 is first-direction-passable**" AND "V11 is straight-passable"** |
| The route for the train to drive out of the "turnback area 9" | "X20 is second-direction-passable" AND "X21 is side-passable" |

FIG. 7b

Scene 6 (alternative turning back at a scissors crossover)

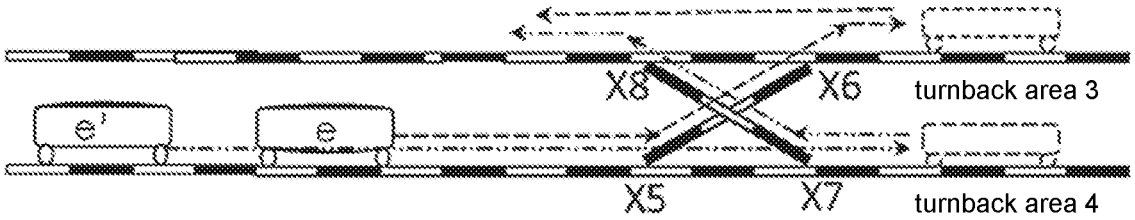

| | The list of the state(s) of the railway turnout(s) involved in the route |
|---|---|
| The route for the train *e* to drive into the "turnback area 3" | "X5 is side-passable" AND "X6 is side-passable" |
| The route for the train to drive out of the "turnback area 3" | "X6 is straight-passable" AND "X8 is straight-passable" |
| The route for the train *e'* to drive into the "turnback area 4" | "X5 is straight-passable" AND "X7 is straight-passable" |
| The route for the train to drive out of the "turnback area 4" | "X7 is side-passable" AND "X8 is side-passable" |

FIG. 8a

Improved scheme for the Scene 6

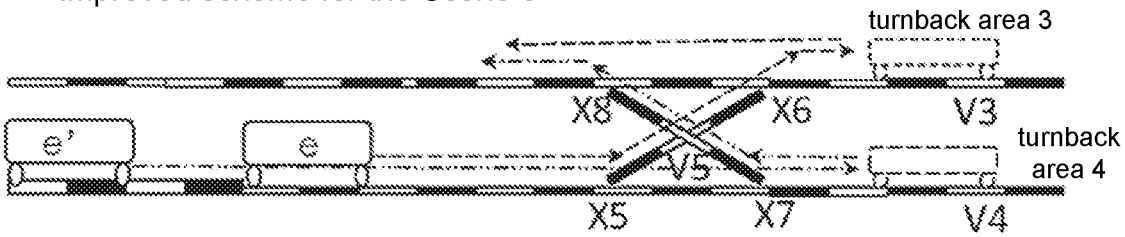

| | The list of the state(s) of the railway turnout(s) involved in the route |
|---|---|
| The route for the train *e* to drive into the "turnback area 3" | "X5 is side-passable" **AND "V5 is first-direction-passable"** AND "X6 is side-passable" **AND "V3 is straight-passable"** |
| The route for the train to drive out of the "turnback area 3" | "X6 is straight-passable" AND "X8 is straight-passable" |
| The route for the train *e'* to drive into the "turnback area 4" | "X5 is straight-passable" AND "X7 is straight-passable" **AND "V4 is straight-passable"** |
| The route for the train to drive out of the "turnback area 4" | "X7 is side-passable" **AND "V5 is second-direction-passible"** AND "X8 is side-passable" |

FIG. 8b

Scene 7 (Alternative turning back in a double turnback track parallel layout)

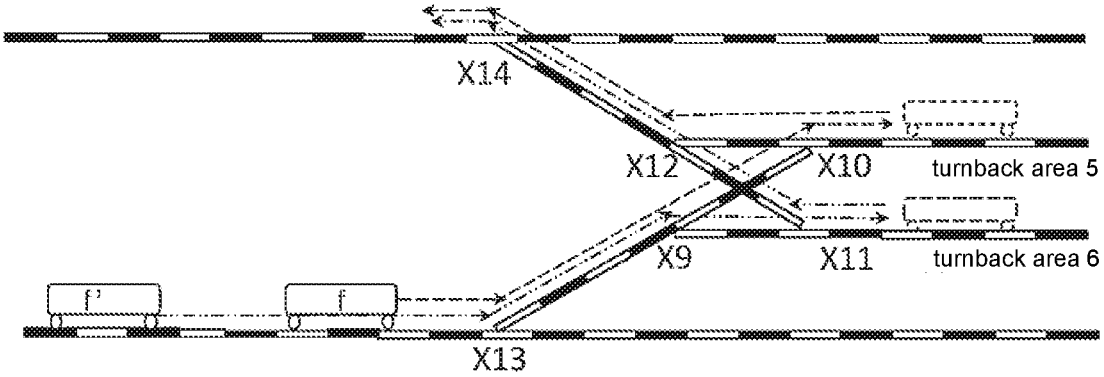

| | The list of the state(s) of the railway turnout(s) involved in the route |
|---|---|
| The route for the train *f* to drive into the "turnback area 5" | "X13 is side-passable" AND "X9 is straight-passable" AND "X10 is side-passable" |
| The route for the train to drive out of the "turnback area 5" | "X10 is straight-passable" AND "X12 is side-passable" AND "X14 is side-passable" |
| The route for the train *f'* to drive into the "turnback area 6" | "X13 is side-passable" AND "X9 is side-passable" AND "X11 is straight-passable" |
| The route for the train to drive out of the "turnback area 6" | "X11 is side-passable" AND "X12 is straight-passable" AND "X14 is side-passable" |

FIG. 9a

Improved scheme for the Scene 7

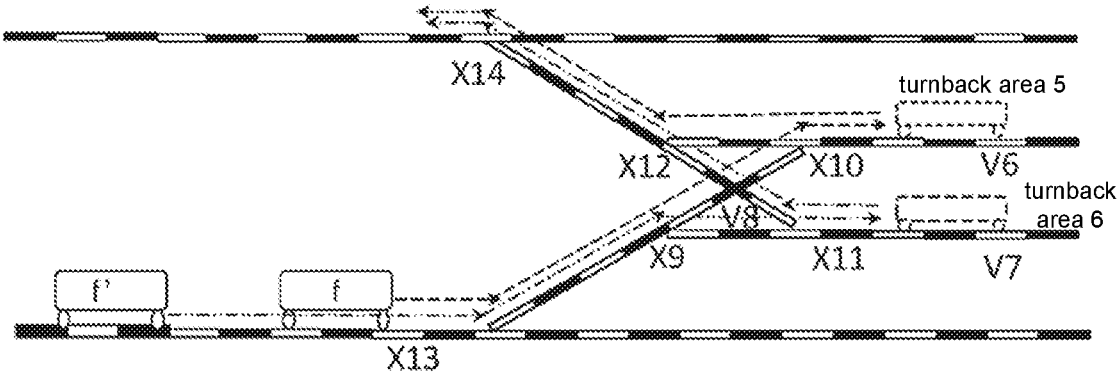

| | The list of the state(s) of the railway turnout(s) involved in the route |
|---|---|
| The route for the train *f* to drive into the "turnback area 5" | "X13 is side-passable" AND "X9 is straight-passable" **AND "V8 is first-direction-passable"** AND "X10 is side-passable" **AND "V6 is straight-passable"** |
| The route for the train to drive out of the "turnback area 5" | "X10 is straight-passable" AND "X12 is side-passable" AND "X14 is side-passable" |
| The route for the train *f'* to drive into the "turnback area 6" | "X13 is side-passable" AND "X9 is side-passable" AND "X11 is straight-passable" **AND "V7 is straight-passable"** |
| The route for the train to drive out of the "turnback area 6" | "X11 is side-passable" **AND "V8 is second-direction-passable"** AND "X12 is straight-passable" AND "X14 is side-passable" |

FIG. 9b

RAILWAY TURNOUT CONTROL METHOD AND SYSTEM

This application is a U.S. national stage application under 35 U.S.C. § 371 of International Application No. PCT/CN2015/095523, filed on Nov. 25, 2015, designating the United States of America, the entire contents of which are hereby incorporated by reference.

TECHNICAL FIELD

The present disclosure generally relates to the railway turnout control field of rail transit, and in particular to a railway turnout control method and system.

BACKGROUND

In the technologies related to rail transit control, railway turnout control is one of the basic processes that guarantee the safety and continuity of the operation of rail transit.

A train may pass through a railway turnout area according to a driving plan. From the perspective of space, the driving plan may represent a driving trajectory of the train. The trajectory may be embodied as a specific arrangement and establishment of a route along which the train is to pass through the railway turnout area. The arrangement of the route may correspond to a single record in a list of certain railway turnout with its state. The establishment of the route involves, for the driving safety of the train and at a safety distance ahead of the train, claiming all the railway turnouts included in the single record according to their corresponding state included in the record for the passage of the train.

During an establishment of a route, the claims of all the railway turnouts of the route may be completed at almost the same time. As a train travels along the route, when the train safely passes through a railway turnout of the route (the entire train just leaves the railway turnout and is outside the boundaries of the railway turnout), the claim of the railway turnout may be released (so that the next train to pass through the railway turnout may claim the railway turnout again). Such a situation may occur multiple times until the train safely passes through the route and all the claims of the corresponding railway turnouts are released. The train may continue driving until the next route related to the driving plan is approached and the above process may be repeated. In the end, the train may stop at a stopping point where the end of the trajectory corresponding to the driving plan is located. For operational needs, the stopping point where the end of the trajectory is generally located in an area of a turnback stopping point.

In the commonly acknowledged safety control logic of a railway turnout, conflicting routes are not allowed to be established simultaneously at any moment. A claim of a railway turnout for a train is monopolistic (or exclusive). That is, a certain railway turnout can only be claimed for one train at any moment. A claimed railway turnout can be claimed again only if the claim is released.

It has been found that, the railway turnout control scheme corresponding to the aforementioned driving-plan-guided process for a train passing through a railway turnout area is flawed when being implemented in an area including a turnback stopping point (or be referred to as a "turnback area"). For example, when a train drives into a turnback area and stops, that is, it has not driven out of the turnback area, if another train has established a route into the turnback area, as the turnout has been claimed by the other train, the train stops in the turnback area may not be able to establish a route to drive out of the turnback area. Meanwhile, as the turnback area is occupied, the other train that has established the route into the turnback area may not be able to drive into the turnback area. Eventually, the stalemate of the two trains may cause deadlock situation, which may hinder the normal operation of the turnback area. What's worse, in a scenario having crossed routes, a train conflict may occur.

It can be seen that, in the existing railway turnout control schemes, basic control logics such as "only one of the conflicting routes is allowed to be established for a passage of a train at any moment" and "a railway turnout can only be claimed for one train at any moment" can be easily satisfied, but there are still problems such as deadlock situation of the turnback area and insufficient safety protection for the crossed routes. Such problems may be encountered in the operations of a variety of rail transit systems such as railways, subways, light rail, trams, monorails, maglev trains, etc. As important technical issues of modern signal systems (such as communication based train control system, CBTC) that fully adopt modern techniques related to computers, software, communication, and automatic control, these problems must be addressed.

SUMMARY

Embodiments of the present disclosure provides a railway turnout control method and system to solve problems such as deadlock situation in a turnback area and insufficient safety protection of crossed routes.

A first aspect of the present disclosure provides a railway turnout control method. The method may include: constructing a data space corresponding to a railway turnout area; adding a virtual railway turnout, in the data space, to an area in which a target turnback stopping point is located; adding the virtual railway turnout to a railway turnout list corresponding to a route along which a train drives into the area; and not releasing claim of the virtual railway turnout when the train stops at the turnback stopping point.

A second aspect of the present disclosure provides a railway turnout control method related to crossed routes. The method may include: constructing a data space corresponding to a railway turnout area; adding to the data space a virtual railway turnout at a location corresponding to a junction of the crossed routes; adding the virtual railway turnout to each railway turnout list corresponding to each route passing through the junction.

A third aspect of the present disclosure provides a railway turnout control system. The system may include: a construction unit, configured to construct a data space corresponding to a railway turnout area; an addition unit, configured to add a virtual railway turnout, in the data space, to an area in which a target turnback stopping point is located; a management unit, configured to add the data of the virtual railway turnout to a railway turnout list corresponding to a route along which a train drives into the area, wherein the claim of the virtual railway turnout is not released when the train stops at the turnback stopping point.

A fourth aspect of the present disclosure provides a railway turnout control system related to crossed routes. The system may include: a construction unit, configured to construct a data space corresponding to a railway turnout area; an addition unit, configured to add to the data space a virtual railway turnout at a location corresponding to a junction of the crossed routes; a management unit, configured to add the virtual railway turnout to a railway turnout list corresponding to each of the routes passing through the junction.

The fifth aspect of the present disclosure provides a computing device. The computing device may include: at least one processor, a storage device, a bus, and a communication interface. The storage device may be configured to store a program. The program may stores computer-computer-executable instructions. The at least one processor may be coupled to the storage device via the bus. When the computing device is running, the at least one processor may execute the program stored in the storage device, causing the computing device to implement the railway turnout control method provided by the first aspect of the present disclosure, or the railway turnout control method related to crossed routes provided by the second aspect of the present disclosure.

A sixth aspect of the present disclosure provides a computer-readable storage medium storing one or more programs. The one or more programs may include instructions. When the instructions are executed by a computing device including one or more processors, the computing device may be caused to implement the railway turnout control method provided by the first aspect of the present disclosure, or the railway turnout control method related to crossed routes provided by the second aspect of the present disclosure.

As can be seen from the above that, in some implementable embodiments of the present disclosure, a technique scheme may be adopted, which may include adding, in the data space corresponding to a railway turnout area, a virtual railway turnout to an area in which a target turnback stopping point is located, adding the virtual railway turnout to a railway turnout list corresponding to a route along which a train drives into the area, wherein the claim of the virtual railway turnout is not released when the train stops at the turnback stopping point. So that, when a train stops in the area in which a target turnback stopping point is located, as the virtual turnout claimed for the train is not released, other trains cannot establish a route into the area before the train drives out of the area, thus avoiding the deadlock situation caused by the stalemate of two trains.

In some other implementable embodiments of the present disclosure, another technique scheme may be adopted, which may include: adding to the data space corresponding to a railway turnout area, a virtual railway turnout at a location corresponding to a junction of crossed routes; and adding the virtual railway turnout to a railway turnout list corresponding to each railway turnout list corresponding to each route passing through the junction. So that, when a train establishes a route passing through the junction, since the virtual railway turnout of the junction is claimed, other trains may not be able to establish a route passing through the junction, thereby avoiding a train conflict.

BRIEF DESCRIPTIONS OF THE DRAWINGS

In order to illustrate methods of the embodiments of the present disclosure more clearly, the drawings to be used for describing the embodiments and the prior arts is briefly described below. Obviously, the drawings in the following descriptions are merely embodiments of the present invention, and for those skilled in the art, other drawings may also be obtained based on these drawings without any creative work.

Figure 1:
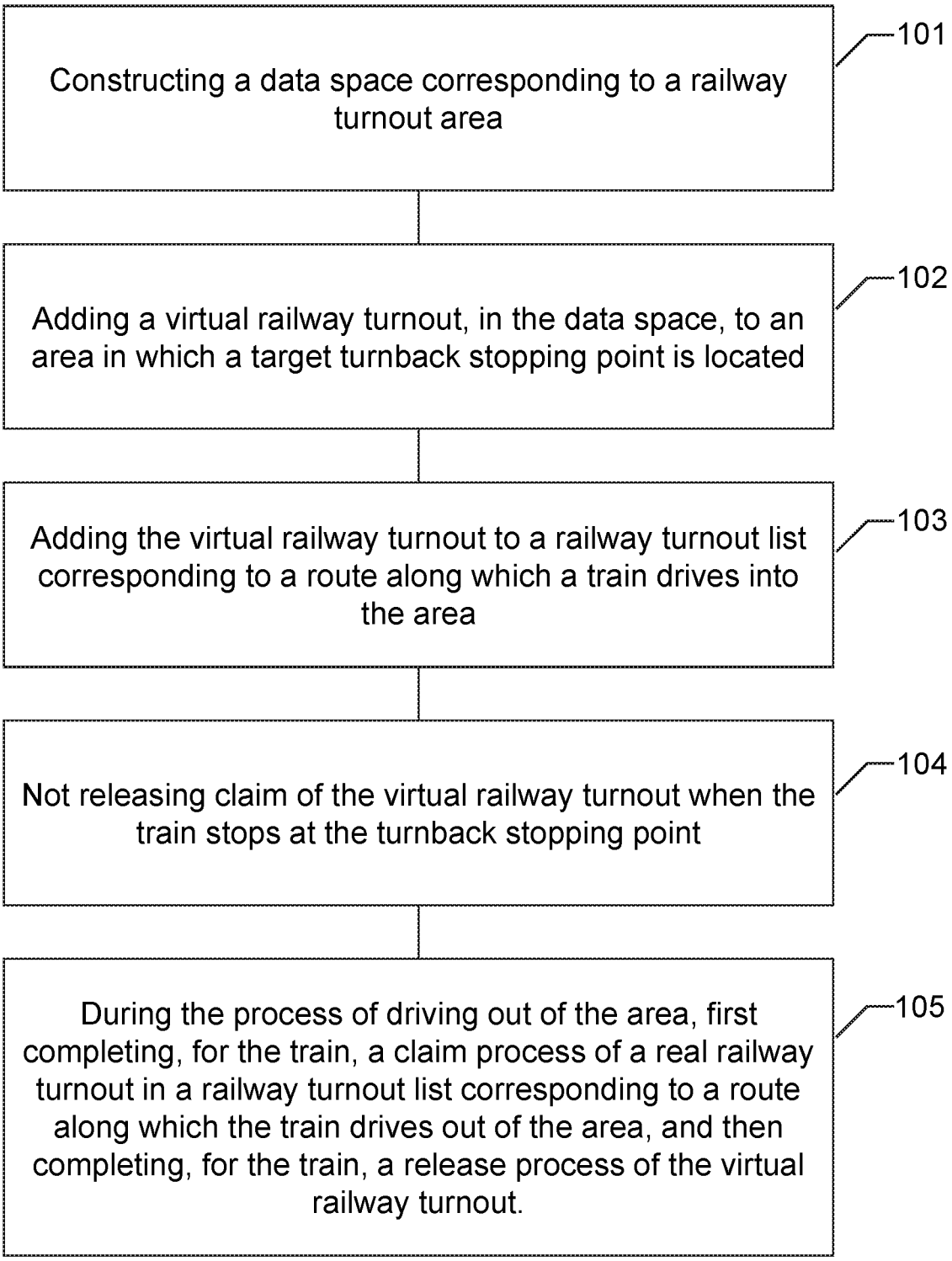
FIG. 1 is a schematic flowchart illustrating an exemplary process for controlling railway turnouts according to a first embodiment of the present disclosure.
Figure 10:
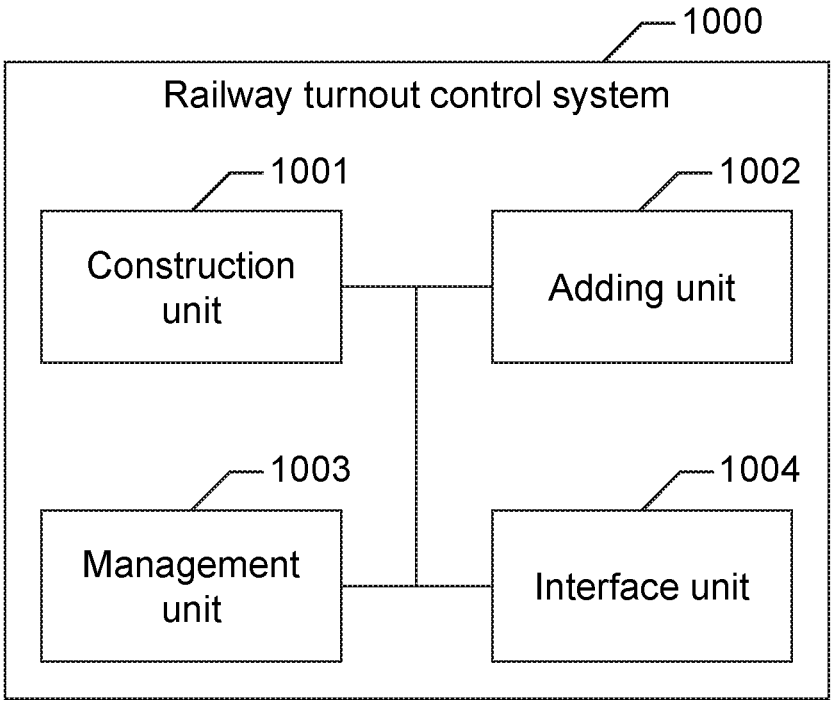
Figure 11:
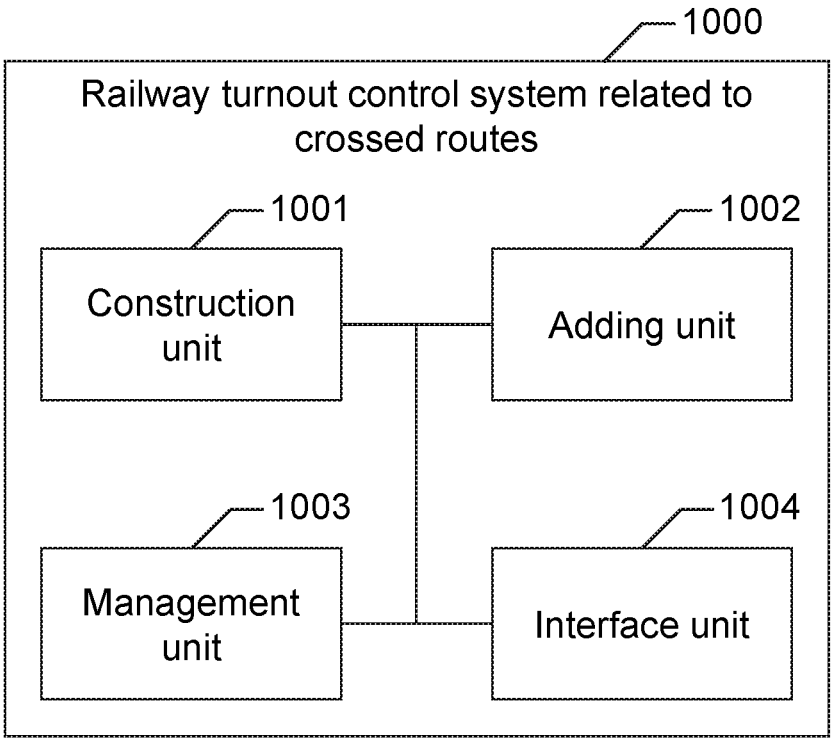
Figure 12:
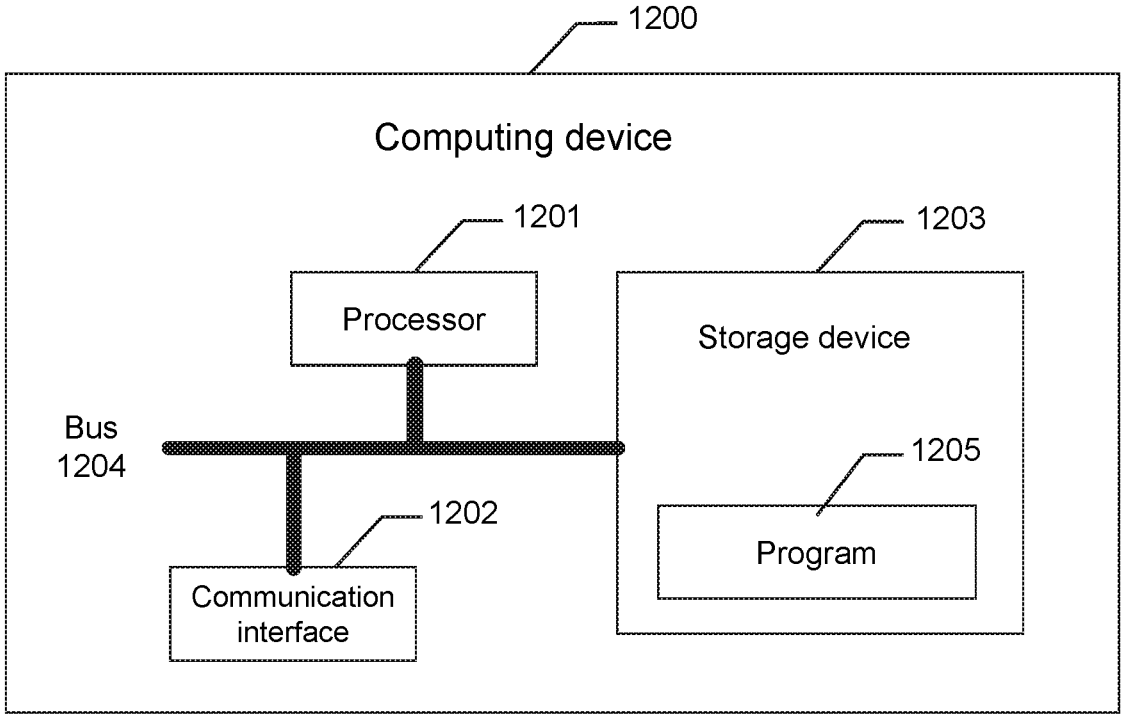

FIG. 3*a* is a schematic diagram illustrating issues caused by implementing an existing technical scheme in a scene 1;

FIG. 3*b* is a schematic diagram illustrating an improvement by implementing a technical scheme of the present disclosure in the scene 1;

FIG. 4*a* is a schematic diagram illustrating issues caused by implementing an existing technical scheme in a scene 2;

FIG. 4*b* is a schematic diagram illustrating an improvement by implementing a technical scheme of the present disclosure in the scene 2;

FIG. 5*a* is a schematic diagram illustrating issues caused by implementing an existing technical scheme in a scene 3;

FIG. 5*b* is a schematic diagram illustrating an improvement by implementing a technical scheme of the present disclosure in the scene 3;

FIG. 6*a* is a schematic diagram illustrating issues caused by implementing an existing technical scheme in a scene 4;

FIG. 6*b* is a schematic diagram illustrating an improvement by implementing a technical scheme of the present disclosure in the scene 4;

FIG. 7*a* is a schematic diagram illustrating issues caused by implementing an existing technical scheme in a scene 5;

FIG. 7*b* is a schematic diagram illustrating an improvement by implementing a technical scheme of the present disclosure in the scene 5;

FIG. 8*a* is a schematic diagram illustrating issues caused by implementing an existing technical scheme in a scene 6;

FIG. 8*b* is a schematic diagram illustrating an improvement by implementing a technical scheme of the present disclosure in the scene 6;

FIG. 9*a* is a schematic diagram illustrating issues caused by implementing an existing technical scheme in a scene 7;

FIG. 9*b* is a schematic diagram illustrating an improvement by implementing a technical scheme of the present disclosure in the scene 7;

FIG. 10 is a schematic diagram illustrating the structure of an exemplary system for controlling railway turnouts according to an embodiment of the present disclosure;

FIG. 11 is a schematic diagram illustrating the structure of another exemplary system for controlling railway turnouts according to an embodiment of the present disclosure; and FIG. 12 is a schematic diagram of an exemplary computing device according to an embodiment of the present disclosure.

DETAILED DESCRIPTION

In order to provide a better understanding of the methods described in the present disclosure for those skilled in the art, embodiments of the present disclosure are described in detail with reference to the accompanying drawings. Obviously, the described embodiments are merely a part of the present invention, rather than all the possible embodiments. Based on embodiments provided in the present disclosure, all the other embodiments obtained by those skilled in the art without any creative effort should fall into the scope of the present disclosure.

As used herein, the terms "first," "second," "third," and the like, in the specification, claims and drawings of the present disclosure may be intended to distinguish different objects and not intended to imply a specific sequence. Further, the terms "comprise", "include", "have", and any variant thereof, are intended to cover non-exclusive inclusions. For example, processes, methods, systems, products, or devices comprising or including a series of steps or units are not limited to the illustrated steps or units, but may also optionally comprise or include steps or units not illustrated, and/or steps or units inherent to these processes, methods, products, or devices.

The present disclosure is further described in terms of specific embodiments.

Embodiment 1

Referring to FIG. 1, an embodiment of the present disclosure provides a railway turnout control method, which may include:

101. Constructing a data space corresponding to a railway turnout area;

102. Adding a virtual railway turnout, in the data space, to an area in which a target turnback stopping point is located;

103. Adding the virtual railway turnout to a railway turnout list corresponding to a route along which a train drives into the area;

104. Not releasing claim of the virtual railway turnout when the train stops at the turnback stopping point.

Optionally, step 104 may further include:

150. During the process of driving out of the area, first completing, for the train, a claim process of a real railway turnout in a railway turnout in a railway turnout list corresponding to a route along which the train drives out of the area and then completing, for the train, a release process of the virtual railway turnout.

Optionally, the area may include a target turnback stopping point providing a turnback for a short-routing train. The step 102 for adding a virtual railway turnout may further include adding data of the virtual railway turnout to a railway turnout list corresponding to a route along which a long-routing train passes through the area.

It is to be expressly stated that, the area mentioned in the above steps refers to an area in which a target turnback stopping point is located, which may also be referred to as a turnback area.

As can be seen from the above, for issues such as the deadlock situation of a turnback area and insufficient safety protection of crossed routes, based on the concept that "there is a mapping relationship between the data recording space (or be referred to as data space) of a control system and the reality space of an entity controlled by the control system", the present disclosure further introduces a virtual railway turnout into the data space. As a virtual object, the virtual railway turnout may not necessarily have its counterparts in the reality space. But in the data space, the virtual railway turnout may fully implement control logic such as the conflict between routes and the monopolistic claim of a railway turnout. In the data recording space, like a real turnout, a virtual railway turnout may have multiple data-defined descriptors associated with the layout of the corresponding station or depot, such as geographical location and topological location (the location of a real railway turnout may be the junction or bifurcation of the centerlines of associated tracks; the selection of one or more parameters associated with the location of a virtual railway turnout may be determined according to the purpose of the establishment of the virtual railway turnout), boundaries (take the junction or bifurcation of the centerlines of tracks associated with a real turnout as the center, the centerline of each track leading outwards the railway turnout may have a vertical projection point of a nearest fouling point marker on the centerline of the track, the projection point may server as a boundary of the real turnout on the side of the each of tracks; the selection of parameters associated with the location and boundaries of a virtual railway turnout may be determined according to the purpose of the establishment of the virtual railway turnout), passing state and the number of state, claim and release, and a specific route it incorporated into, etc. On the basis of this virtual object, the railway turnout control method provided by the present disclosure is developed.

The method for controlling one or more railway turnout controls in the present disclosure may include: adding a virtual railway turnout in an area in which a target turnback stopping point is located, incorporate the virtual railway turnout into a route along which a train drives into the area by adding data of the virtual railway turnout to a railway turnout list corresponding to the route, and causing the claim of the virtual railway turnout not to be released when the train stops at the turnback stopping point by arranging the location and boundaries of the virtual railway turnout in the area. Consequently, the real turnout most proximate to the train in the route along which the train drives into the area may be released when the train stops, so as to create conditions for a successful establishment of a route for the train to turn back out of the area. At this point, as the virtual railway turnout is still in the claimed state, other trains cannot successfully establish a route into the area.

The above method describes a process for a train driving into the turnback area. The method may further comprise, when the train drives out of the area, first completing a claiming process of at least one real railway turnout in a railway turnout list corresponding to a route along which the train drives out of the turnback area, then completing a releasing process of the virtual railway turnout claimed for the train after the at least one real railway turnout is successfully claimed. Consequently, when the train turn back out of the area, a route out of the area may be established first. As the train drives along the route, when the entire train just leaves the virtual railway turnout and is outside the boundaries of the virtual railway turnout, a release of the claim of the virtual railway turnout may be triggered so as to create necessary conditions for a next establishment of a route into the area.

If the area in the above method is to provide a turnback for a short-routing train in a scenario where long-routing trains and short-routing trains are operated in a nest manner, that is, assuming that the area includes a target turnback stopping point for short-routing trains, then, if a route of a long-routing train also passes through the area (or be referred to as turnback area), data of the virtual railway turnout may be added to the railway turnout list corresponding to the route along which the long-routing train passes through the area.

As can be seen from the above that, in some implementable embodiments of the present disclosure, a technique scheme may be adopted, which may include adding, in the data space corresponding to a railway turnout area, a virtual railway turnout to an area in which a target turnback stopping point is located, and adding the virtual railway turnout to a railway turnout list corresponding to a route along which a train drives into the area, wherein the claim of the virtual railway turnout is not released when the train stops at the turnback stopping point. So that, when a train stops in the area in which a target turnback stopping point is located, as the virtual turnout claimed for the train is not released, other trains cannot establish a route into the area before the train drives out of the area, thus avoiding the deadlock situation caused by the stalemate of two trains.

Embodiment 2

Figure 2:
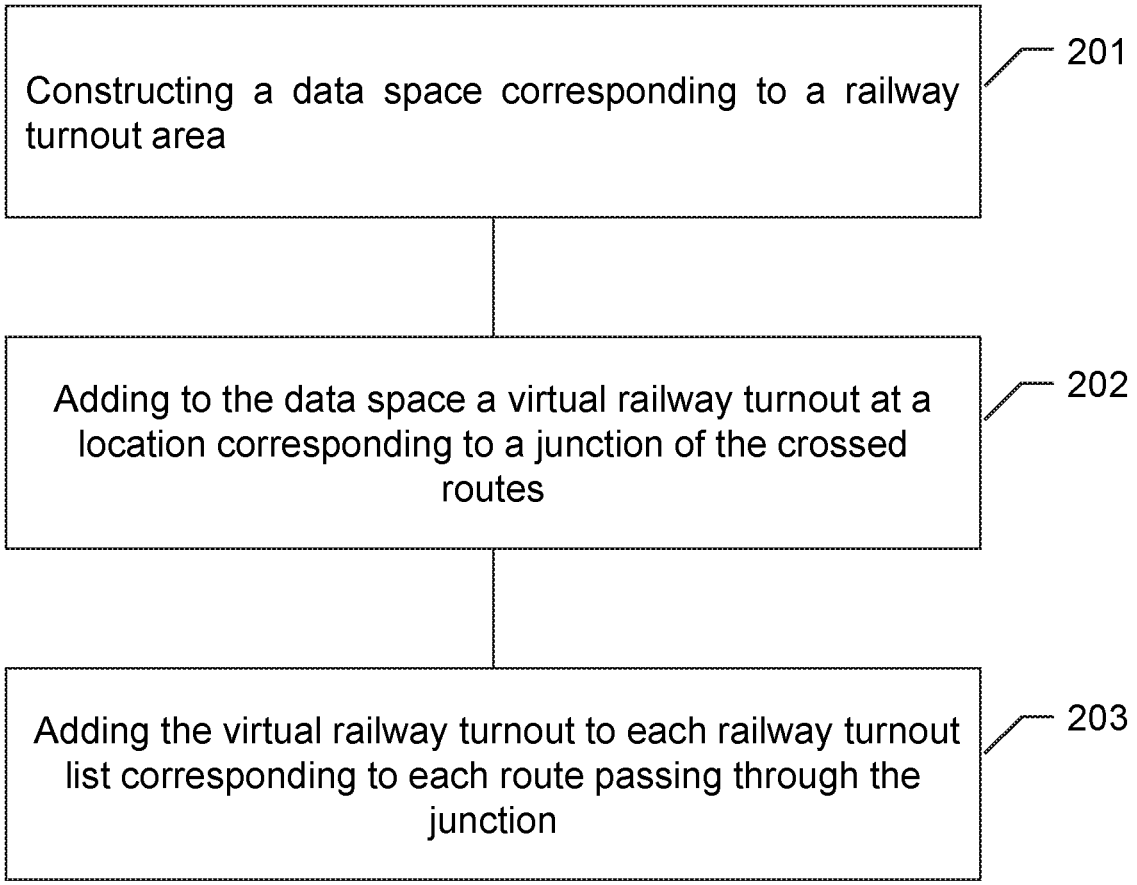
FIG. 2 is a schematic flowchart illustrating an exemplary process for controlling railway turnouts according to a second embodiment of the present disclosure.

Referring to FIG. 2, an embodiment of the present disclosure provides a railway turnout control method related to crossed routes, comprising:

201. Constructing a data space corresponding to a railway turnout area;

202. Adding to the data space a virtual railway turnout at a location corresponding to a junction of the crossed routes;

203. Adding the virtual railway turnout to each railway turnout list corresponding to each route passing through the junction.

On the basis of the same concept of the embodiment, an embodiment of the present disclosure also provides a railway turnout control method in a scenario related to crossed routes defending against each other, such as a scenario related to a scissors crossover and a scenario related to double turnback track parallel layout. The method may include adding a virtual railway turnout to each railway turnout list corresponding to each route passing through the junction, and adding the virtual railway turnout to each railway turnout list corresponding to each route passing through the junction. Such a data arrangement can fully embody the conflict between all the routes passing through the junction so that the conflicting routes protection logic may be functioning.

As can be seen from the above, in some implementable embodiments of the present disclosure, a technical scheme may be adopted, which may include adding, to the data space corresponding to a railway turnout area, a virtual railway turnout at a location corresponding to a junction of the crossed routes; adding the virtual railway turnout to each railway turnout list corresponding to each route passing through the junction. Consequently, when a train establishes a route passing through the junction, since the virtual railway turnout at the junction is claimed, other trains cannot establish a route passing through the junction, thereby avoiding a train conflict.

For a better understanding of the technical schemes provided by the embodiments of the present disclosure, the technical schemes of the present disclosure may be further described below in terms of the implementations in a number of specific scenes.

Scene 1: Side-in-Straight-Out Turning Back at a Single Crossover in a Terminal Station.

FIG. 3*a* is a schematic diagram illustrating deadlock situation caused by a train driving conflict possibly occurs during an implementation of a railway turnout control scheme according to the prior arts in the scene 1. Assuming that a train b is stopping in a "turnback area 1" and all the railway turnouts (railway turnouts X1 and X2 illustrated in the figure) of the route along which the train b drives into "turnback area 1" have already been released, but a route out of the "turnback area 1" (railway turnout X2 in the figure) hasn't been established and the train b is waiting for turning back out of the area. Meanwhile, a train a has already establish a route into the "turnback area 1" and all the railway turnouts (railway turnouts X1 and X2 in the figure) of the route has been claimed for the train a to drive into the "turnback area 1". Resulting from such a technique scheme, the train b cannot drive out of the "turnback area 1" and may continue occupying the "turnback area 1" because a route out of "turnback area 1" cannot be successfully established (due to the claim of railway turnout X2 for the train a). However, although a route into the "turnback area 1" has been established for the train a, it still cannot drive into the "turnback area 1" (due to the continuous occupation of "turnback area 1" for the train b). Consequently, neither the train a nor the train b can drive forward and the stalemate may cause deadlock situation, which may block the normal operation of the "turnback area 1".

FIG. 3*b* is a schematic diagram illustrating an improvement by implementing the railway turnout control method according to the embodiment 1 of the present disclosure in the scene 1. A virtual railway turnout V1 in FIG. 3*b* may have only one passing state, and the parameters such as the location and boundaries of the virtual railway turnout V1 may be selected to ensure a precondition that "a claim of the virtual railway turnout V1 is not released when a train drives into the 'turnback area 1' and stops at the turnback stopping point included in the 'turnback area 1', and the claim is maintained until a route out of the 'turnback area 1' is successfully established when the train turns back out of the 'turnback area 1'". For example, a selection that "the distance between the location of the virtual railway turnout V1 and the turnback stopping point in the 'turnback area 1' is within 10 meters, and the boundary of the virtual railway turnout V1 near the railway turnout X2 coincides with the boundary of the railway turnout X2 near the virtual railway turnout V1" may satisfy such a precondition. The selection of the boundary of the virtual railway turnout V1 on the opposite side may be determined in conjunction with other operational purposes. For example, without considering other factors, the end of the track of the "turnback area 1" may be simply treated as the boundary of the virtual railway turnout V1 on said opposite side. In practice, the data of the virtual railway turnout can be flexibly selected. Assuming that a train b is stopping in the "turnback area 1" and all the real railway turnouts (railway turnouts X1 and X2 illustrated in the figure) of the route along which the train b drives into the "turnback area 1" have already been released, but the virtual railway turnout V1 incorporated into the route into the "turnback area 1" is still being claimed. The train a cannot establish a route into the "turnback area 1" because the virtual railway turnout V1 is still claimed for the train b, therefore the railway turnout X2 cannot be claimed for the train a (at this moment, the train a is stopping and waiting outside the route into the "turnback area 1"). When the train b drives out of the "turnback area 1", a route along which the train b drives out of the "turnback area 1" may be established by claiming the railway turnout X2. As the train b drives along the route, when the entire train just leaves the virtual railway turnout V1 and is outside the boundaries of V1, the release of the claim of the virtual railway turnout V1 of the train b may be triggered and completed. At this moment, as the railway turnout X2 is still claimed for the train b, a route into the "turnback area 1" cannot be successfully established. Until the train b drives completely out of the "turnback area 1", further drives out of the railway turnout X2, and is outside the boundaries of the railway turnout X2, the release of the claim of the virtual turnout X2 of the train b may be triggered and completed. At this moment, the turning back process of the train b in the "turnback area 1" has been completed, no train has occupied the "turnback area 1", and both of the railway turnout X2 and the virtual railway turnout V1 are not claimed. This situation creates conditions for the train a to successfully establish a route into the "turnback area 1". There will be no deadlock situation during the whole operation of "turnback area 1".

Scene 2: Side-in-Straight-Out Turning Back at a Single Crossover in an Intermediate Station.

FIG. 4*a* is a schematic diagram illustrating deadlock situation caused by a train driving conflict possibly occurred during an implementation of a railway turnout control scheme according to the prior arts in the scene 2. Assuming that a route into a "turnback area 2" has been established for a short-routing train c by claiming all the railway turnouts (railway turnouts X3 and X4 illustrated in the figure) and the short-routing train c is going to drive into the "turnback area 2". As the long-routing train d cannot establish a route passing through the "turnback area 2" (because the railway turnout X4 has already been claimed for the train c in the figure), the train d can only temporarily stop near the railway turnout X4, taking the boundary of the railway turnout X4 as a danger point. The area where the long-routing train d is temporarily stopping at may occupy a space of the "turnback area 2", causing that the short-routing train c cannot entirely drive into the "turnback area 2". Consequently, neither the train c nor the train d can drive forwards and the stalemate may cause deadlock situation, which may block the normal operation of the "turnback area 2".

FIG. 4*b* is a schematic diagram illustrating an improvement by implementing the railway turnout control method according to the embodiment 1 of the present disclosure in the scene 2. The method has already incorporated the deadlock preventing mechanism similar to the one described in FIG. 3*b*. The selection of the parameters associated with the location and the boundary near the railway turnout X4 of the virtual railway turnout V2 is similar to that of V1 described in FIG. 3*b*. The parameter(s) associated with the boundary away from X4 may be selected to ensure that, before a route for the long-routing train d to pass through the "turnback area 2" is successful established (for the partial-route train), when the train d is stopping and waiting, there will not be deadlock situation similar to the one described in FIG. 4*a* that "the area where the long-routing train d is temporarily stopping at occupies a space of the 'turnback area 2', causing that the short-routing train c cannot entirely drive into the 'turnback area 2'"

Scene 3: Straight-in-Side-Out Turning Back at a Single Crossover in a Terminal Station.

FIG. 5*a* is a schematic diagram illustrating deadlock situation caused by a train driving conflict possibly occurred during an implementation of a railway turnout control scheme according to the prior arts in the scene 3. The deadlock situation in the scene 3 is similar to that of the scene 1. When a train is occupying the "turnback area 7" and waiting to drive out of the "turnback area 7" while another train (the train g illustrated in the figure) has already established a route into the "turnback area 7", the train cannot establish a route out of the "turnback area 7". Consequently, neither of the two trains can drive forward and the stalemate may cause deadlock situation, which may block the normal operation of the "turnback area 7".

FIG. 5*b* is a schematic diagram illustrating an improvement by implementing the railway turnout control method according to the embodiment 1 of the present disclosure in the scene 3. The selection of the parameters and the deadlock prevention mechanism of the virtual railway turnout V9 may be similar to those of the virtual railway turnout V1 illustrated in FIG. 3*b*, the descriptions of which are not repeated herein.

Scene 4: Straight-in-Side-Out Turning Back at a Single Crossover in an Intermediate Station.

FIG. 6*a* is a schematic diagram illustrating deadlock situation caused by a train driving conflict possibly occurred during an implementation of a railway turnout control scheme according to the prior arts in the scene 4. The situation illustrated in FIG. 6*a* is similar to that of the scene 1, the detailed descriptions of which are not repeated here.

FIG. 6*b* is a schematic diagram illustrating an improvement by implementing the railway turnout control method according to the embodiment 1 of the present disclosure in the scene 4. The selection of the parameters and the deadlock prevention mechanism of the virtual railway turnout V10 may be similar to those of the virtual railway turnout V1 illustrated in FIG. 3*b*, the descriptions of which are not repeated herein.

Scene 5: Turning Back in a Single Turnback Track Parallel Layout.

FIG. 7*a* is a schematic diagram illustrating deadlock situation caused by a train driving conflict possibly occurred during an implementation of a railway turnout control scheme according to the prior arts in the scene 5. The situation illustrated in FIG. 7*a* is similar to that of the scene 1, the detailed descriptions of which are not repeated here.

FIG. 7*b* is a schematic diagram illustrating an improvement by implementing the railway turnout control method according to the embodiment 1 of the present disclosure in the scene 5. The selection of the parameters and the deadlock prevention mechanism of the virtual railway turnout V11 may be similar to those of the virtual railway turnout V1 illustrated in FIG. 3*b*, the descriptions of which are not repeated herein.

Scene 6: Alternative Turning Back at a Scissors Crossover.

FIG. 8*a* is a schematic diagram illustrating an insufficient safety protection with deadlock situation possibly occurred during an implementation of a railway turnout control scheme according to the prior arts in the scene 6. A route into the "turnback area 3" and a route out of the "turnback area 4" may cross each other. If there are not sufficient protective measures, the two crossed routes may be established concurrently, causing a potential safety hazard of a train conflict. In the "turnback area 3" of the scene 6, there is a potential risk of deadlock situation that is similar to the one in the "turnback area 1" of the scene 1. In the "turnback area 4" of the scene 6, there is a potential risk of deadlock situation that is similar to the one in the "turnback area 7" of the scene 3.

FIG. 8*b* is a schematic diagram illustrating an improvement by implementing the railway turnout control method according to the embodiment 2 of the present disclosure in the scene 6. The location of the virtual railway turnout V5 in FIG. 8*b* is at the junction of the crossover. As the virtual railway turnout V5 is at the junction of real routes, its location, boundary points, passing state, and the number of states cannot be arbitrarily selected. The boundary point of V5 on an associated track is the vertical projection point of a fouling point marker nearest to the centerline of the track on the centerline of the track. As one of the two passing states of V5, the state "first-direction-passable" indicates that an establishment of a route direction into the "turnback area 3" by connecting the railway turnouts X5 and X6 is enabled. As the other passing state of V5, "second-direction-passable" indicates that an establishment of a route direction out of the "turnback area 4" by connecting the railway turnouts X7 and X8 is enabled. Procedures using a virtual railway turnout V3 scheme to prevent deadlock situation occurred on trains driving into and driving out of the "turnback area 3" are similar to the procedures using the virtual railway turnout V1 to prevent deadlock situation occurred on trains passing through the "turnback area 1" in the scene 1. Procedures using a virtual railway turnout V4 scheme to prevent deadlock situation occurred on trains driving into and driving out of the "turnback area 4" are similar to the procedures using the virtual railway turnout V9 to prevent deadlock situation occurred on trains passing through the "turnback area 7" in the scene 3. The virtual railway turnout V5 may be respectively incorporated into the route into the "turnback area 3" and the route out of the "turnback area 4", so that an evident conflict relationship is formed between the two routes, and a perfected protection of crossed routes may be achieved by using a conflicting routes protection logic.

Scene 7: Alternative Turning Back in a Double Turnback Track Parallel Layout.

FIG. 9*a* is a schematic diagram illustrating an insufficient safety protection with deadlock situation possibly occurred during an implementation of a railway turnout control scheme according to the prior arts in the scene 5. A route into the "turnback area 3" and a route out of the "turnback area 6" may cross each other. If there are not sufficient protective measures, the two crossed routes may be established concurrently, causing a potential safety hazard of a train conflict. In the "turnback area 5" of the scene 7, there is a potential risk of deadlock situation that is similar to the one in the "turnback area 1" of the scene 1. In the scene 7, there is also a situation that, when a train is occupying the "turnback area 6" and waiting to drive out of the "turnback area 6" while another train (the train f illustrated in the figure) has already established a route into the "turnback area 6", the train cannot establish a route out of the "turnback area 6". The stalemate may cause deadlock situation, which may block the normal operation of the "turnback area 6".

FIG. 9*b* is a schematic diagram illustrating an improvement by implementing the railway turnout control method according to the embodiment 2 of the present disclosure in the scene 6. The location of the virtual railway turnout V8 in FIG. 9*b* is at the junction of the crossover. As the virtual railway turnout V8 is at the junction of real routes, its location, boundary points, passing state, and the number of states cannot be arbitrarily selected. The boundary point of V8 on an associated track is the vertical projection point of a fouling point marker nearest to the centerline of the track on the centerline of the track. As one of the two passing states of V8, the state "first-direction-passable" indicates that an establishment of a route direction into the "turnback area 5" by connecting the railway turnouts X9 and X10 is enabled. As the other passing state of V8, "second-direction-passable" indicates that an establishment of a route direction out of the "turnback area 6" by connecting the railway turnouts X11 and X12 is enabled. Procedures using a virtual railway turnout V6 scheme to prevent deadlock situation occurred on trains driving into and driving out of the "turnback area 5" are similar to the procedures using the virtual railway turnout V1 to prevent deadlock situation occurred on trains passing through the "turnback area 1" in the scene 1. Procedures using a virtual railway turnout V7 scheme to prevent deadlock situation occurred on trains driving into and driving out of the "turnback area 6" are similar to the procedures using the virtual railway turnout V9 to prevent deadlock situation occurred on trains passing through the "turnback area 7" in the scene 3. The virtual railway turnout V8 may be respectively incorporated into the route into the "turnback area 5" and the route out of the "turnback area 6", so that an evident conflict relationship is formed between the two routes, and a perfected protection of crossed routes may be achieved by using a conflicting routes protection logic. As can be seen from the above, the embodiments of the present invention respectively illustrate the methods of the Embodiment 1 and the Embodiment 2 with their implementations in multiple scenes.

It should be noted that, an interface may also be introduced into the above railway turnout control method using one or more virtual railway turnouts for displaying a layout of a station or depot including the virtual railway turnout and/or information on claiming and releasing of the virtual railway turnout in real time according to data associated with the virtual railway turnout such as the geographical/topological location, boundaries, the passing state & the number of states, the claim & release.

Embodiment 3

For a better implementation of the foregoing schemes of the embodiments of the present disclosure, related devices that can facilitate the implementation of the foregoing schemes are also provided below.

Referring to FIG. 10, an embodiment of the present disclosure provides a railway turnout control system 1000, which may comprise:

A construction unit 1001, configured to construct a data space corresponding to a railway turnout area;

An addition unit 1002, configured to add a virtual railway turnout, in the data space, to an area in which a target turnback stopping point is located;

A management unit 1003, configured to add the data of the virtual railway turnout to a railway turnout list corresponding to a route along which a train drives into the area, wherein the claim of the virtual railway turnout is not released when the train stops at the turnback stopping point.

In some embodiments, the management unit 1003 is further configured to, during the process of driving out of the area, first complete, for the train, a claim process of a real railway turnout in a railway turnout in a railway turnout list corresponding to a route along which the train drives out of the area and then completing, for the train, a release process of the virtual railway turnout.

In some embodiments, the area may include a target turnback stopping point providing a turnback for a short-routing train. The addition unit 1002 may be further configured to add data of the virtual railway turnout to a railway turnout list corresponding to a route along which a long-routing train passes through the area.

In some embodiments, the system 1000 may further comprise:

An interface unit 1004, configured to display a layout of a station or depot including the virtual railway turnout and/or information on claiming and releasing of the virtual railway turnout in real time.

The system in the embodiment of the present disclosure may be, for example, a computing device.

It is understood that, the functions of the various functional modules in the system of the embodiment of the present disclosure may be specifically implemented according to the methods of the foregoing method embodiments. For a specific implementation process thereof, reference may be made to the related descriptions in the foregoing method embodiments, and which are not repeated here.

As can be seen from the above that, in some implementable embodiments of the present disclosure, a technique scheme may be adopted, which may include adding, in the data space corresponding to a railway turnout area, a virtual railway turnout to an area in which a target turnback stopping point is located, and adding the virtual railway turnout to a railway turnout list corresponding to a route along which a train drives into the area, wherein the claim of the virtual railway turnout is not released when the train stops at the turnback stopping point. So that, when a train stops in the area in which a target turnback stopping point is located, as the virtual turnout claimed for the train is not released, other trains cannot to establish a route into the area before the train drives out of the area, thus avoiding the deadlock situation caused by the stalemate of two trains.

Embodiment 4

Referring to FIG. 11, an embodiment of the present disclosure provides a railway turnout control system 1100 related to crossed routes, which may comprise:

A construction unit 1101, configured to construct a data space corresponding to a railway turnout area;

An addition unit 1102, configured to add to the data space, a virtual railway turnout at a location of the data space corresponding to a junction of the crossed routes;

A management unit 1103, configured to add the virtual railway turnout to each railway turnout list corresponding to each route passing through the junction.

In some embodiments, the system 1100 may further comprise:

An interface unit 1104, configured to display a layout of a station or depot including the virtual railway turnout and/or information on claiming and releasing of the virtual railway turnout in real time.

The system in the embodiment of the present disclosure may be, for example, a computing device.

It is understood that, the functions of the various functional modules in the system of the embodiment of the present disclosure may be specifically implemented according to the methods of the foregoing method embodiments. For a specific implementation process thereof, reference may be made to the related descriptions in the foregoing method embodiments, and which are not repeated here.

As can be seen from the above, in some implementable embodiments of the present disclosure, a technical scheme may be adopted, which may include adding, to the data space corresponding to a railway turnout area, a virtual railway turnout at a location corresponding to a junction of the crossed routes; adding the virtual railway turnout to each railway turnout list corresponding to each route passing through the junction. Consequently, when a train establishes a route passing through the junction, since the virtual railway turnout at the junction is claimed, other trains cannot establish a route passing through the junction, thereby avoiding a train conflict.

Embodiment 5

Referring to FIG. 12, an embodiment of the present disclosure also provides a computing device 1200. The computing device 1200 may comprise: a processor 1201, a storage device 1202, a bus 1203, and a communication interface 1204. The storage device 1202 may be configured to store a program 1205, and the program 1205 may include computer-executable instructions. The processor 1201 may be coupled to the storage device 1202 via the bus 1203. When the computing device 1200 is running, the processor 1201 may execute the program 1205 included in the storage device 1202, causing the computing device 1200 to implement the railway turnout control method described in connection with the above method embodiment 1, or the railway turnout control method related to the crossed routes as described in connection with the above method embodiment 2.

Embodiment 6

An embodiment of the present disclosure also provides a computer-readable storage medium storing one or more programs. The one or more programs may include instructions. When the instructions are executed by a computing device including one or more processors, the computing device may be caused to implement the railway turnout control method described in connection with the above method embodiment 1, or the railway turnout control method related to the crossed routes as described in connection with the above method embodiment 2.

In the above embodiments, the descriptions of each embodiment may have their own emphasis, for parts not described in detail in some embodiment, reference may be made to the related descriptions of other embodiments.

It should be noted that, for simplicity of description, each of the foregoing method embodiments may be described as a combination of a series of actions. But those skilled in the art should understand that, the present disclosure is not limited to the described sequence of actions, as certain steps can be performed in another sequence or be performed concurrently according to the present disclosure. Further, those skilled in the art should also understand that, embodiments described in the specification are all preferred embodiments, and the associated unit(s) or action(s) is not necessarily required by the present disclosure.

It is obvious to those skilled in the art that, for convenience and concise of description, for detailed operation procedures of the foregoing systems, devices, and units, reference may be made to the corresponding procedures of the foregoing method embodiments, the descriptions of which are not repeated herein.

In some embodiments provided in the present application, it should be understood that, the disclosed systems, devices, and methods, may be implemented otherwise. For instance, the foregoing device embodiments are only for demonstration purposes. For example, the division of the units is merely based on a logical delineation, and other division formats may be adopted in practical implementations, such as combining multiple units or components, integrating multiple units or components into another system, omitting or skipping certain features. In addition, the illustrated or discussed mutual couplings, direct couplings, or communication connections may be indirect couplings or communication connections through interfaces/ports, devices, or units, and may be electrical, mechanical, or in other forms.

The units described as separate parts may or may not be physically separated. A component (or components) illustrated as a unit may or may not be a physical unit. That is, the component(s) may be located in one place, or be distributed among multiple network nodes. According to practical needs, some or all of the units may be selected to achieve the purpose of the schemes of the present embodiment.

In addition, various functional units of each embodiment of the present disclosure may be integrated in one processing unit, or be physically standalone respectively. Alternatively, two or more units may be integrated into one unit. The integrated unit may be implemented by hardware, or be implemented as a software functional unit.

An integrated unit, if implemented in the form of a software functional unit and sold or used as a standalone product, may be stored in a computer-readable storage medium. On the basis of such concept, the essential portion, the portion contributes to the prior art, or the entire or part of any technical scheme in the present disclosure, may be embodied in the form of a software product. The computer software product may be stored in a storage medium, and may include instructions causing a computing device (which may be a personal computer, a server, or a network device, etc.) to perform all or some of the steps of the method of each embodiment of the present invention. The above storage medium may include various media capable of storing program codes, such as a USB flash drive, a removable hard disk, a read-only memory (ROM), a random access memory (RAM), a magnetic disk, or an optical disk.

Having thus described the railway turnout control method and system provided by the present disclosure in detail, the principle and implementation of the present disclosure have been described in terms of specific embodiments. The descriptions of the foregoing embodiments are merely for providing a better understanding of the methods and the basic concept of the present disclosure. Meanwhile, for those skilled in the art, on the basis of the concept of the present disclosure, changes may be made to the specific implementation manners and the application field. In conclusion, the contents of the present specification should not be construed as limiting the present disclosure.

I claim:

1. A railway turnout control method, comprising:

constructing a data space corresponding to a railway turnout area;

adding a virtual railway turnout, in the data space, to a virtual space corresponding to a turnback area in which a target turnback stopping point is located;

adding the virtual railway turnout to a railway turnout list corresponding to a route along which a train drives into the turnback area; and maintaining claim of the virtual railway turnout when the train stops at the target turnback stopping point.

2. The method of claim 1, further comprising:

when the train drives out of the turnback area:

(i) completing, for the train, a claim process of at least one real railway turnout in a railway turnout list corresponding to a route along which the train drives out of the turnback area; and (ii) completing, for the train, a release process of the virtual railway turnout after the at least one real railway turnout is successfully claimed.

3. The method of claim 1, wherein:

the target turnback stopping point included in the turnback area provides a turnback for a short-routing train; and the adding the virtual railway turnout comprises adding the virtual railway turnout to a railway turnout list corresponding to a route along which a long-routing train passes through the turnback area.

4. The method of claim 1, wherein:

the railway turnout area further includes crossed routes, each of which leads to a corresponding turnback area; and the method further comprising:

adding a first virtual railway turnout at a virtual location of the data space corresponding to a junction of the crossed routes;

for each of the turnback area, adding a second virtual railway turnout, in the data space, to a virtual space corresponding to a corresponding turnback area;

adding the first virtual railway turnout and a corresponding one of the second virtual railway turnouts to a railway turnout list corresponding to a route passing through the junction along which a train drives into a target turnback area of the turnback areas; and maintaining the claim of the second virtual railway turnout when the train stops at a target turnback stopping point of the target turnback area.

5. The method of claim 4, wherein the first virtual railway turnout has a plurality of passing states, each of the plurality of passing states indicates that an establishment of a corresponding route passing through the junction is enabled.

6. The method of claim 1, further comprising:

displaying a layout of a station or depot including the virtual railway turnout or information on claiming and releasing of the virtual railway turnout in real time.

7. A railway turnout control method related to crossed routes, comprising:

constructing a data space corresponding to a railway turnout area;

adding to the data space a virtual railway turnout at a virtual location corresponding to a junction of the crossed routes; and adding the virtual railway turnout to each railway turnout list corresponding to each route passing through the junction.

8. The method of claim 7, wherein the first virtual railway turnout has a plurality of passing states, each of the plurality of passing states indicates that an establishment of a corresponding route passing through the junction is enabled.

9. The method of claim 7, further comprising:

displaying a layout of a station or depot including the virtual railway turnout or information on claiming and releasing of the virtual railway turnout in real time.

10. A railway turnout control system, comprising:

a construction unit, configured to construct a data space corresponding to a railway turnout area;

an addition unit, configured to add a virtual railway turnout, in the data space, to a virtual space corresponding to a turnback area in which a target turnback stopping point is located; and a management unit, configured to add the virtual railway turnout to a railway turnout list corresponding to a route along which a train drives into the turnback area, and maintain claim of the virtual railway turnout when the train stops at the turnback stopping point.

11. The system of claim 10, wherein the management unit is configured further to:

when the train drives out of the turnback area;

(i) complete, for the train, a claim process of at least one real railway turnout in a railway turnout list corresponding to a route along which the train drives out of the turnback area; and (ii) complete, for the train, a release process of the virtual railway turnout after the at least one real railway turnout is successfully claimed.

12. The system of claim 10, wherein:

the target turnback stopping point included in the area provides a turnback for a short-routing train, and the addition unit is configured further to add the virtual railway turnout to a railway turnout list corresponding to a route along which a long-routing train passes through the turnback area.

13. The system of claim 10, further comprising:

an interface unit, configured to display a layout of a station or depot including the virtual railway turnout or information on claiming and releasing of the virtual railway turnout in real time.

* * * * *